US009434054B2

(12) United States Patent
Lim

(10) Patent No.: US 9,434,054 B2
(45) Date of Patent: Sep. 6, 2016

(54) ADJUSTABLE WRENCH

(71) Applicant: Leon A. Lim, Richmond Hill (CA)

(72) Inventor: Leon A. Lim, Richmond Hill (CA)

( * ) Notice: Subject to any disclaimer, the term of this patent is extended or adjusted under 35 U.S.C. 154(b) by 340 days.

(21) Appl. No.: 13/999,362

(22) Filed: Feb. 18, 2014

(65) Prior Publication Data

US 2014/0283655 A1 Sep. 25, 2014

Related U.S. Application Data

(60) Provisional application No. 61/852,936, filed on Mar. 25, 2013.

(51) Int. Cl.
*B25B 13/32* (2006.01)
*B25B 13/18* (2006.01)

(52) U.S. Cl.
CPC ..... *B25B 13/32* (2013.01); *B25B 13/18* (2013.01)

(58) Field of Classification Search
CPC ..... B25B 13/12; B25B 13/18; B25B 13/32
USPC ..... 81/77
See application file for complete search history.

(56) References Cited

U.S. PATENT DOCUMENTS

| | | | | | |
|---|---|---|---|---|---|
| 685,389 | A * | 10/1901 | Tupper | B25B 13/12 | 81/77 |
| 1,440,950 | A * | 1/1923 | Allen | B25B 13/12 | 81/77 |
| 1,444,907 | A * | 2/1923 | Fisher | B25B 13/12 | 81/77 |
| 1,478,512 | A * | 12/1923 | Fisher | B25B 13/12 | 81/77 |
| 2,293,002 | A * | 8/1942 | Huffman | B25B 13/28 | 81/112 |
| 4,916,987 | A * | 4/1990 | Le Duc | B25B 13/18 | 81/163 |
| 7,156,001 | B2 * | 1/2007 | Cluthe | B25B 13/18 | 81/127 |
| 2014/0000416 | A1 * | 1/2014 | Scheper | B25B 13/08 | 81/77 |

* cited by examiner

*Primary Examiner* — David B Thomas

(57) ABSTRACT

A wrench having two separate jaw arms, at least one jaw member on each said arm, and a sliding cam engaging the two arms, so that the two arms can be adjusted together or apart while maintaining the respective jaw members in a precise parallel relationship, and in which the cam engages both the jaw arms simultaneously.

5 Claims, 2 Drawing Sheets

ADJUSTABLE WRENCH

FIELD OF THE INVENTION

This application is based on U.S. Provisional Application 61/852,936 filed Mar. 25, 2013, Title: Adjustable Wrench; Inventor: Lean A. Lim; the priority of which is claimed. The invention relates to an adjustable wrench, and in particular in which the adjustment is provided by means of a sliding cam.

BACKGROUND OF THE INVENTION

Various forms of adjustable wrenches are well known. One is the so called "Monkey Wrench", in which there are two separate jaws, like scissors, which can be swung together by means of operating two handles. Another form is a wrench in which there is one fixed jaw and in which there is an adjustable jaw operated by means of a screw threaded rod, and a knurled nut. Numerous other forms of adjustable wrenches have been proposed.

The monkey wrench type of adjustment suffers from the problem that while it provides a firm grip on the nut, it can easily damage the nut so that it can not be reused. The form of wrench in which the adjustment is achieved by a threaded rod and a nut, is usually unsatisfactory. It is difficult to adjust the wrench to exactly the right opening, and it is common that the adjustment does not remain fixed, and the wrench may end up damaging the nut.

One of the fundamental problems with adjustable wrenches is that the two jaws of the wrench should be maintained exactly parallel to one another, in order to grasp the opposite flat surfaces on a nut. However, this is seldom the case. Usually one jaw will move and result in a poor fit on the nut.

BRIEF SUMMARY OF THE INVENTION

With a view to overcoming these disadvantages and providing an improved form of adjustment for an adjustable wrench, the invention provides a wrench having two separate jaw arms, at least one jaw member on each said arm, and a sliding cam engaging the two arms, so that the two arms can be adjusted together or apart while maintaining the respective jaw members in a precise parallel relationship, and in which the cam engages both of the jaw arms simultaneously.

In a particularly useful case, the wrench provides two sets of jaw blades on each said arm, namely a larger first set and a smaller second set, the first and second sets being secured at opposite ends of the respective jaw arms.

The jaw arms are formed as two continuous plates with the jaw blades formed at opposite ends of the plates.

The cam, which adjusts the spacing between the jaw blades is slideable along the jaw arms from one end to the other, thereby providing a means of adjusting the spacing between the jaw blades.

The adjustment cam preferably defines sliding surfaces which are oblique to one another and which slide along the surfaces of the jaw arms.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
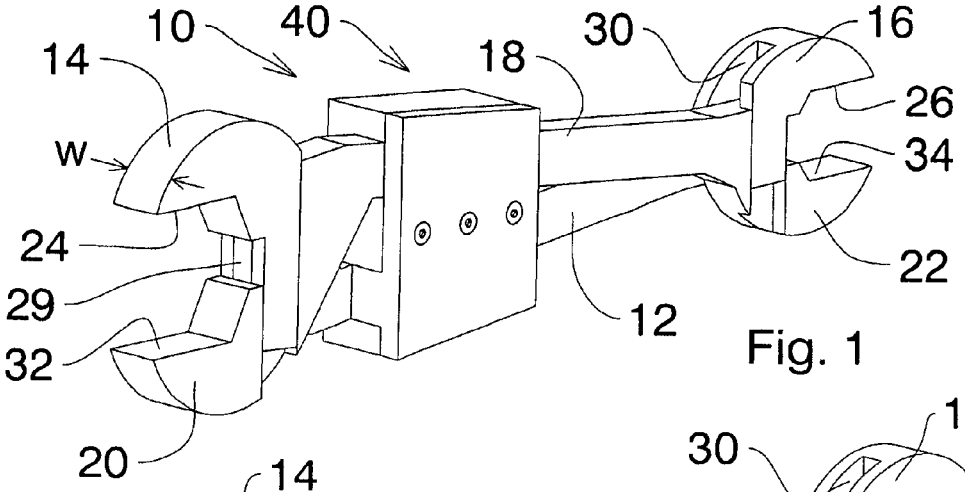
FIG. 1 is a perspective illustrating an adjustable wrench.
Figure 2:
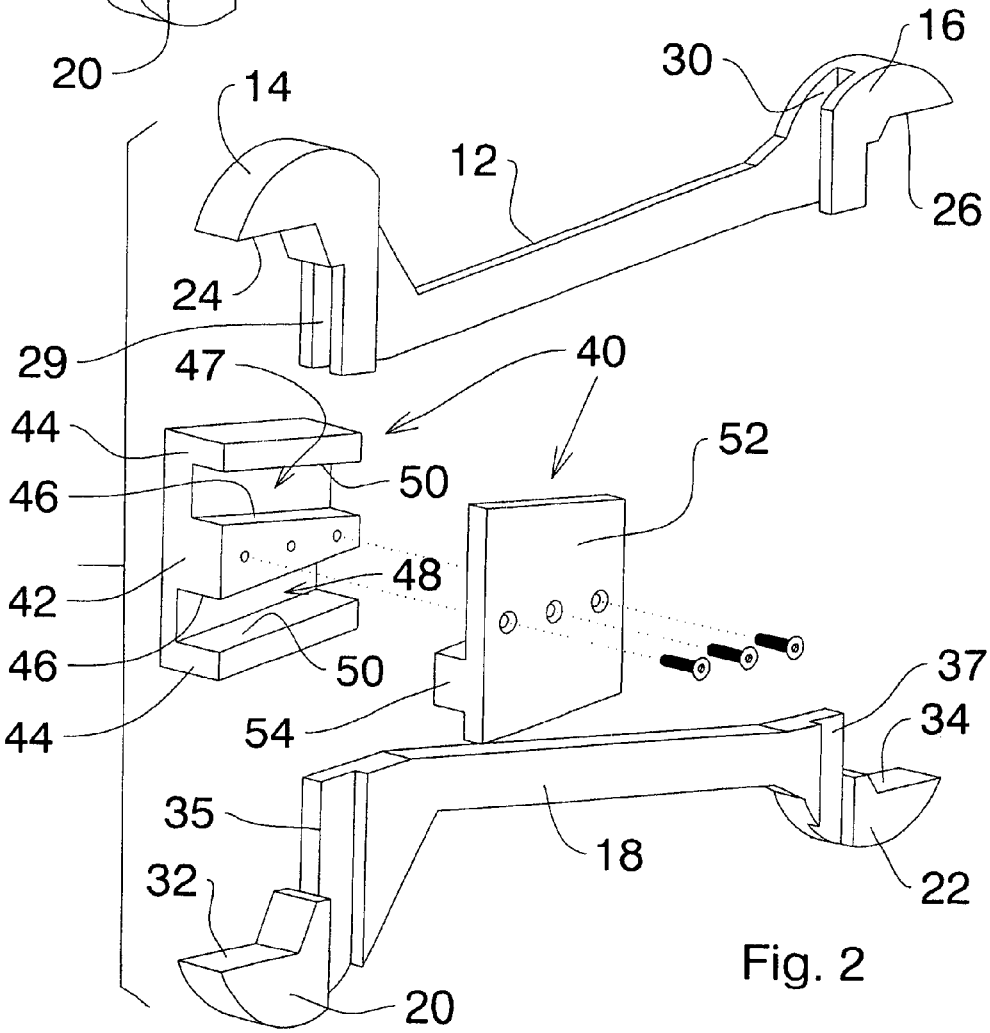
FIG. 2 is an exploded perspective of FIG. 1.

The invention is illustrated in the form of a wrench indicated as (10) which comprises a first jaw arm (12) with a larger jaw part (14), and a smaller jaw part (16), all being formed as one single integral part. A second jaw arm (18) comprises a larger jaw part (20), a smaller jaw part (22) again being formed as a single integral part.

The arms have a thickness (T).

On the first jaw arm (12), both the large and the small jaw parts (14,16) define jaw blades (24) and (26) of a predetermined width (W).

The width (W) is greater than the thickness (T) of said arum (12).

The jaw blades are integrally formed with the jaw arm (12). The larger jaw part (14) is formed with two spaced apart portions which define between them a slot (29). The smaller jaw part (16) is formed in two parts and defines between them a slot (30).

On arm (18) the larger jaw part (20) is formed with a reduced thickness defining a slide part (35). The smaller jaw part (22) is formed with a reduced thickness slide part (37). It will be seen that the slide part (35) fits within the slot (29) of the arm (12) and the slide part (37) fits within the slot (30) of the arm (12).

In this embodiment, the arm portions are formed integrally in one piece with the blades. It will however be appreciated that this could be of two part construction.

The jaw blades (24) and (26) define planes which are parallel.

The second jaw arm (18) is formed with two jaw blades, namely a larger jaw blade (32) and a smaller jaw blade (34). Each of the jaw blades (32, 34) are located in predetermined planes parallel to but spaced from one another.

Both blades have a predetermined width (W), greater than (T). Blades (24,26, 32,34) are offset relative to their respective arms, so as to lie in common planes.

The cam (40) comprises a central contact body (42) and two spaced apart outer contact bodies (44).

The central contact body (42) defines a generally truncated wedge shape in plan, defining angled cam surfaces (46). The outer contact bodies (44) are formed with outer cam surfaces (50). The cam surfaces (46) of the centre contact body (42) and surfaces (50) of the outer contact bodies (44) are parallel to one another, and define diverging axes. The spacing between the outer cam surfaces (50) and the central cam surfaces (46) of the centre body is equal to the width of each of the arms (12, 18), and define between them respective grooves, (47, 48). It is noted that groove (47) is of a first predetermined depth and groove (48) is of a greater depth than groove (47). Groove (47) receives the jaw arm (18) and groove (48) receives the jaw arm (12).

In one embodiment, the centre contact body (42) and the outer contact bodies (44) are mounted and supported by a side plate (52). Preferably, to facilitate assembly, the side plate (52) is removably attached by means of screws or bolts.

An abutment (54) on plate (52) engages arm (12), thereby ensuring that the arm (12) is supported on either side in groove (48).

By sliding the cam (40) in one direction along arms (12, 18), the spacing between the jaw blades at opposite ends will be increased.

Figure 3:
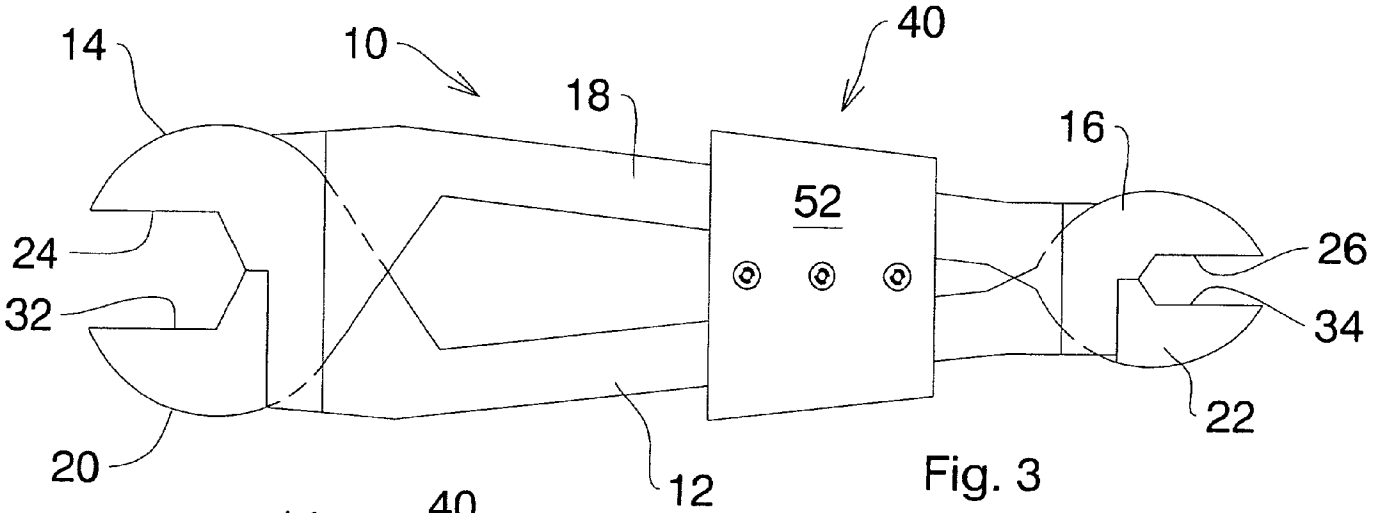
FIG. 3 is a side elevation of an adjustable wrench, showing the jaws in a first position; and, FIG. 4 is a side elevation corresponding to FIG. 1, showing the jaws in another position, wider apart than in the position of FIG. 3.
Figure 4:
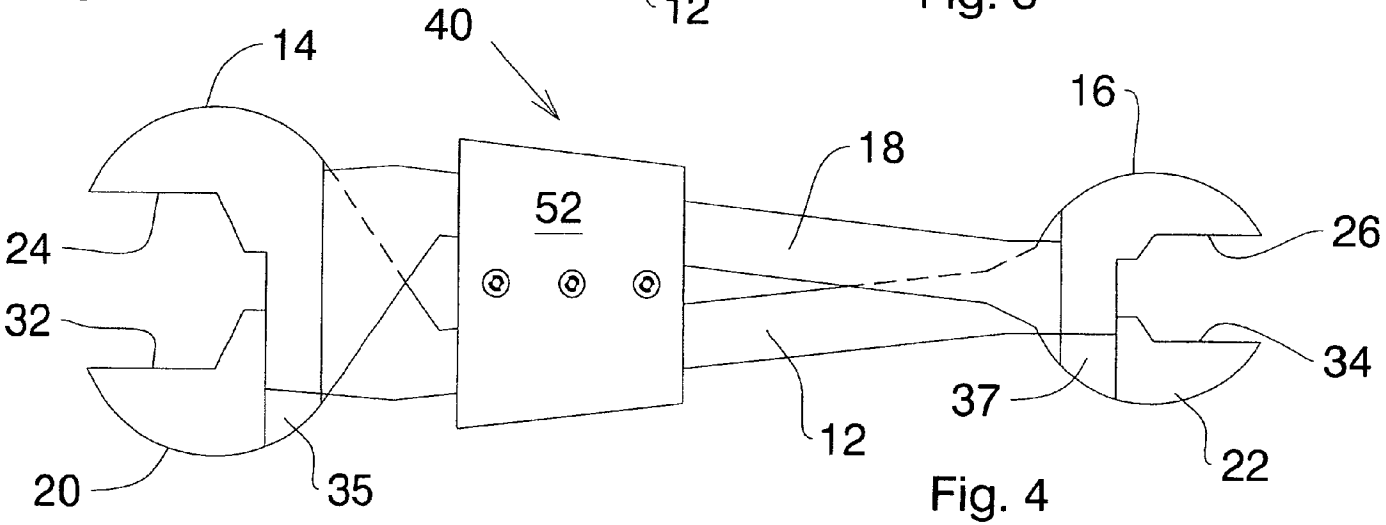

By sliding the cam (40) in the opposite direction, the spacing between both sets of jaw blades will be reduced (FIGS. 3 and 4).

In this way it is possible to simply slip one or the other sets of jaw blades around a nut and then slide the cam (40) until the jaw blades contact opposite sides of the nut. The wrench is then used to rotate the nut. The jaw blades will hold the nut securely, as long as the cam is not moved.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A wrench having two separate jaw arms, and comprising;

two jaw members on each said arm, one at one end of each said arm and the other at the other end of each said arm;

a sliding cam engaging the two arms, so that the two arms can be adjusted together or apart while maintaining the respective jaw members in a precise parallel relationship, two linear grooves formed along diverging linear axes, in said cam, one said arm being received in one said groove and the other said arm being received in the other said groove and in which the cam engages both the jaw arms simultaneously; and, wherein said jaw members on one said arm define respective slots, and wherein said jaw members on the other said arm define respective sliders received in said slots.

2. A wrench having two separate jaw arms as claimed in claim 1, wherein one of said grooves in said sliding cam define a first predetermined depth, and wherein the other said groove in said sliding cam defines a depth greater than said predetermined depth.

3. A wrench having two separate jaw arms as claimed in claim 2, including an abutment on said sliding cam engaging one of said arms in said groove of greater depth.

4. A wrench having two separate jaw arms as claimed in claim 3, wherein the sliding cam defines a first cam body portion defining said grooves and a cam plate portion attached to said cam body portion, securing said arms in said grooves.

5. A wrench having two separate jaw arms as claimed in claim 4, wherein said abutment is formed on said cam plate portion registering with said groove of greater depth.

* * * * *